US008042353B2

(12) United States Patent
Lee et al.

(10) Patent No.: US 8,042,353 B2
(45) Date of Patent: Oct. 25, 2011

(54) REFRIGERATOR DOOR HAVING A SPLASH GUIDE

(75) Inventors: Bok Dong Lee, Changwon-si (KR); Seung Mok Lee, Gimhae-si (KR); Sam Kyu Park, Busan (KR)

(73) Assignee: LG Electronics Inc., Seoul (KR)

( * ) Notice: Subject to any disclaimer, the term of this patent is extended or adjusted under 35 U.S.C. 154(b) by 69 days.

(21) Appl. No.: 12/401,838

(22) Filed: Mar. 11, 2009

(65) Prior Publication Data

US 2009/0178429 A1 Jul. 16, 2009

Related U.S. Application Data

(62) Division of application No. 11/526,088, filed on Sep. 25, 2006, now Pat. No. 7,908,882.

(30) Foreign Application Priority Data

Sep. 23, 2005 (KR) ..... 10-2005-0088914
Nov. 16, 2005 (KR) ..... 10-2005-0109425
Dec. 22, 2005 (KR) ..... 10-2005-0127516
Dec. 30, 2005 (KR) ..... 10-2005-0134683

(51) Int. Cl.
*F25C 5/18* (2006.01)
*F25D 25/00* (2006.01)
*F25D 19/00* (2006.01)
*A47B 96/04* (2006.01)

(52) U.S. Cl. ..... 62/344; 62/378; 62/449; 312/401; 312/405; 312/405.1

(58) Field of Classification Search ..... 62/347, 62/353

See application file for complete search history.

(56) References Cited

U.S. PATENT DOCUMENTS 2,070,943 A * 2/1937 Harold ..... 62/346
2,400,270 A 5/1946 Tinnerman
2,503,693 A * 4/1950 Van Lennep ..... 249/121
3,042,780 A 7/1962 Gursahaney
3,299,663 A 1/1967 Butcher (Continued)

FOREIGN PATENT DOCUMENTS

JP 5-296623 11/1993

(Continued)

OTHER PUBLICATIONS

Korean Notice of Allowance dated May 21, 2007 (App No. 10-2005-0127516).

(Continued)

*Primary Examiner* — Judy Swann
*Assistant Examiner* — Filip Zec
(74) *Attorney, Agent, or Firm* — KED & Associates, LLP

(57) ABSTRACT

A refrigerator door is provided. The refrigerator door has an outer case forming a shape of the refrigerator door, an inner case provided within the outer case to configure a backside of the refrigerator door wherein a space between the inner case and the outer case is charged with a foaming liquid, an ice making unit provided to one side of the inner case to make ice, a fixing unit provided to the space charged with the foaming liquid between the inner case and the outer case and fixing the ice making unit to the refrigerator door, and a dispenser provided to one side of the outer case to discharge the ice supplied by the ice making unit.

11 Claims, 13 Drawing Sheets

U.S. PATENT DOCUMENTS

| | | | | |
|---|---|---|---|---|
| 3,429,140 | A | 2/1969 | White | |
| 3,965,629 | A | 6/1976 | Pearson | |
| 4,190,305 | A | 2/1980 | Knight et al. | |
| 4,593,449 | A | 6/1986 | Meray-Hovarth et al. | |
| 4,649,718 | A * | 3/1987 | Linstromberg et al. | 62/340 |
| 4,966,004 | A | 10/1990 | Midlang et al. | |
| 5,168,621 | A | 12/1992 | Krucke et al. | |
| 5,196,127 | A * | 3/1993 | Solell | 249/121 |
| 5,306,082 | A | 4/1994 | Karlin et al. | |
| 5,357,769 | A | 10/1994 | Crabtree et al. | |
| 5,359,795 | A | 11/1994 | Mawby et al. | |
| 5,486,045 | A | 1/1996 | Dasher | |
| 5,520,453 | A | 5/1996 | Aoki et al. | |
| 5,526,854 | A | 6/1996 | Unger | |
| 5,941,619 | A | 8/1999 | Stieben et al. | |
| 6,148,624 | A | 11/2000 | Bishop et al. | |
| 6,425,425 | B2 | 7/2002 | Bianchi et al. | |
| 6,471,313 | B1 | 10/2002 | Ueda et al. | |
| 6,565,170 | B2 | 5/2003 | Banicevic et al. | |
| 6,588,227 | B2 * | 7/2003 | Kim et al. | 62/344 |
| 6,658,887 | B2 | 12/2003 | Lee et al. | |
| 6,662,574 | B2 * | 12/2003 | Loibl et al. | 62/64 |
| 6,732,537 | B1 | 5/2004 | Anell et al. | |
| 6,907,744 | B2 * | 6/2005 | Miller et al. | 62/74 |
| 7,065,975 | B1 | 6/2006 | Herndon et al. | |
| 7,188,479 | B2 | 3/2007 | Anselmino et al. | |
| 7,281,391 | B2 | 10/2007 | Marret et al. | |
| 7,284,390 | B2 | 10/2007 | Van Meter et al. | |
| 7,437,885 | B2 | 10/2008 | Wu et al. | |
| 7,836,720 | B2 | 11/2010 | Cho et al. | |
| 2003/0213262 | A1 * | 11/2003 | Kang | 62/347 |
| 2004/0108799 | A1 | 6/2004 | Leimkuehler et al. | |
| 2004/0237563 | A1 * | 12/2004 | Lee et al. | 62/340 |

FOREIGN PATENT DOCUMENTS

| | | |
|---|---|---|
| JP | 6-11228 | 1/1994 |
| JP | 06-213559 | 8/1994 |
| JP | 2003-90667 | 3/2003 |
| JP | 2006-153380 | 6/2006 |
| KR | 20-1999-0016107 | 5/1999 |
| KR | 10-2004-0053700 | 6/2004 |
| KR | 10-2005-0094673 | 9/2005 |
| KR | 10-2005-0094674 | 9/2005 |
| KR | 10-2005-0098135 | 10/2005 |
| KR | 10-2006-0062664 | 6/2006 |

OTHER PUBLICATIONS

Korean Notice of Allowance dated May 31, 2007 (App No. 10-2005-0134683).

Korean Notice of Allowance dated Jan. 12, 2009 (App No. 10-2005-0088914).

U.S. Office Action U.S. Appl. No. 11/526,088 dated Jun. 23, 2010.

Mexican Office Action dated Jun. 29, 2010.

U.S. Office Action U.S. Appl. No. 12/401,865 dated Aug. 5, 2010.

U.S. Office Action U.S. Appl. No. 12/401,827 dated Aug. 17, 2010.

U.S. Final Office Action issued in U.S. Appl. No. 12/401,827 dated Jan. 4, 2011.

* cited by examiner

REFRIGERATOR DOOR HAVING A SPLASH GUIDE

CROSS-REFERENCE TO RELATED APPLICATIONS

This application is a Divisional Application of prior U.S. patent application Ser. No. 11/526,088 filed Sep. 25, 2006, now U.S. Pat. No. 7,908,882 which claims the benefit of the Korean Patent Applications Nos. 10-2005-0088914 filed in Korea on Sep. 23, 2005, 10-2005-0109425 filed in Korea on Nov. 16, 2005, 10-2005-0127516 filed in Korea on Dec. 22, 2005 and 10-2005-0134683 filed in Korea on Dec. 30, 2005, which are hereby incorporated by reference as if fully set forth herein.

BACKGROUND OF THE INVENTION

1. Field of the Invention

The present invention relates to a refrigerator, and more particularly, to a refrigerator door. Although the present invention is suitable for a wide scope of applications, it is particularly suitable for facilitating an icemaker unit to be installed to prevent water from splashed on the refrigerator door, filing the door with a foaming liquid and enabling cold air of a refrigerator to flow to an ice-making room without leaking.

2. Discussion of the Related Art

Generally, a refrigerator is a device for storing food at low temperature. And, the refrigerator is a home appliance storing food in a manner of freezing or cooling the food according to its state. Moreover, consumers tend to be interested in large-scale and multi-functional refrigerators to enhance the high standard of living and meet their various tastes.

Recently, a refrigerator is provided with various convenience devices and its internal configuration tends to be diversified to fit a user's taste and use.

A refrigerator according to the present invention is applicable to refrigerators having diverse configurations. In the following description, a bottom freezer type refrigerator among various type refrigerators will be explained for example. In this case, a body the bottom freezer type refrigerator is partitioned into an upper part and a lower part to be provided with a cold storage room and a freezer room, respectively.

FIG. 1 is a front diagram of a refrigerator according to a related art.

Referring to FIG. 1, a body of a refrigerator 1 approximately has a rectangular box shape. An internal space of the body 1 is partitioned into an upper part and a lower part to configure a cold storage room 10 and a freezer room 12.

A refrigerator door 20 is provided to an open front side of the body 1. The refrigerator door 20 is to selectively close or open the open front side of the cold storage room 10 or the freezer room 12. And, the refrigerator door 20 consists of a cold storage room door 22 and a freezer room door 28.

The cold storage room door 22 is to selectively open/close the cold storage room 10 provided to the upper part of the body 1. In case of a side-by-side type refrigerator, the cold storage room door 22 is provided to both right and left sides. The cold storage room door 22 is configured to rotate centering on a corresponding side end. So, the cold storage room door 22 is able to selectively open/close the cold storage room 10.

And, the freezer room door 28 is to selectively open/close the freezer room 12 provided to the lower part of the body 1. The freezer room door 28 has a draw type configuration enabling back-and-forth sliding input/output. So, the freezer room door 28 is able to selectively open/close the freezer room 20.

Meanwhile, a dispenser 30 is provided to one of the right and left side cold storage room doors 22 to open/close the cold storage room 10. The dispenser 30 facilitates purified water or ice to be taken out of the refrigerator without opening the cold storage room door 22. And, the dispenser 30 is provided to a front side of the cold storage room door 22 to be externally exposed.

FIG. 2 is a perspective diagram of a refrigerator door according to a related art, in which an icemaker 42 provided to a backside of the refrigerator door is shown.

Referring to FIG. 2, an ice making room 40 is provided to a backside of a door 20 provided with a dispenser 30. And, an icemaker 42 is provided within the ice making room 40 to make ice.

The ice making room 40 is configured with a recessed part of an inner case 24 forming the backside of the door 22. And, the ice making room 40 is selectively opened/closed by an ice making room door 48 rotatably provided to its side.

An icemaker 42 making ice, an ice bank 44 storing the ice and a transfer means 46 for supplying the stored ice to a discharge part (cf. 1) 32 of the dispenser 30 are provided within the ice making room 40. And, they are directly attached to the inner lateral side of the ice making room 40, i.e., the inner case 24.

FIG. 3 is a perspective diagram of a refrigerator door according to a related art, in which an inner configuration of the refrigerator is shown.

Referring to FIG. 3, a refrigerator door consists of an outer case 26 forming an exterior of the refrigerator door and an inner case 24 provided within the outer case to form a backside of the door.

And, a dispenser case 34 forming a shape of an inside of the dispenser 30 is attached to the inside of the outer case 26.

A tube guide 50 is provided below the dispenser case 34. The tube guide 50 is connected to the dispenser 30 to support a water supply tube 52 via which water flows. And, the tube guide 50 is fixed to a backside of the outer case 26 to enable the water supply tube 52 to keep a predetermined distance.

Meanwhile, for the assembly of the cold storage room door 22, the water supply tube 52, the dispenser 30 and the like are provided to the outer case 26 and the tube guide 50 is installed to adhere closely to the backside of the outer case 26.

After the inner case 24 forming the backside of the cold storage room 22 has been assembled to the outer case 26, an inside of the cold storage room door 22, i.e., a space between the outer case 26 and the inner case 24 is charged with a foaming liquid for insulation.

Finally, the icemaker 42, the ice bank 44 and the transfer means 46 are installed in the ice making room 40 of the inner case 24.

However, the related art has the following problems.

First of all, the tube guide 50, as shown in FIG. 2, is installed to adhere closely to the backside of the outer case 26. If the cold storage room door 22 is charged with the foaming liquid, a flow of the foaming liquid is interrupted by the tube guide 50. So, if is difficult to fill a position in the vicinity of the tube guide 50, a corner part or the like with the foaming liquid. If the insufficient filling of the foaming liquid takes place, insulation efficiency of the cold storage room door 22 is lowered to reduce cooling performance of the refrigerator and raise power consumption. So, overall performance of the refrigerator is degraded.

Secondly, the icemaker 42 is directly provided to the inner case 24 of the ice making room 40. Since rigidity of the inner case 24 is relatively weak, the inner case 24 is unable to avoid drooping or transformation in case that the icemaker 42 is directly assembled to the inner case 24. In particular, in case that the icemaker 42 is directly assembled to the inner case 24 without a separate support structure, a malfunction in detaching the icemaker 42 or taking ice takes place as well as the transformation of the inner case 24.

Thirdly, the icemaker 42 is provided to the inside of the cold storage room door 22. As a user opens or closes the cold storage room door, unfrozen water held by the icemaker 42 is splashed in all directions due to a centrifugal force generated from the rotation of the door. In particular, in the water in the icemaker 42 is splashed, the splashed water is unable to enter the icemaker 42 again but flows downward. So, the flowing water becomes frozen on another part except the icemaker 42 to interrupt operations of parts configuring the icemaker 42.

SUMMARY OF THE INVENTION

Accordingly, the present invention is directed to a refrigerator door that substantially obviates one or more problems due to limitations and disadvantages of the related art.

An object of the present invention is to provide a refrigerator door, by which an inside of a cold storage room door can be evenly filled up with a foaming liquid.

Another object of the present invention is to provide a refrigerator door, by which transformation and breakage of an inner case can be prevented in case of foxing an ice making unit.

A further object of the present invention is to provide a refrigerator door, by which water splashed from the ice making unit can renter the ice making unit if a user opens or closes the refrigerator door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator door according to the present invention includes an outer case forming a shape of the refrigerator door, an inner case provided within the outer case to configure a backside of the refrigerator door wherein a space between the inner case and the outer case is charged with a foaming liquid, an ice making unit provided to one side of the inner case to make ice, a fixing unit provided to the space charged with the foaming liquid between the inner case and the outer case and fixing the ice making unit to the refrigerator door, a dispenser provided to one side of the outer case to discharge the ice supplied by the ice making unit.

Preferably, the refrigerator door further includes a water supply tube connected to the dispenser and supplying the water with the dispenser to discharge the water at the dispenser.

Preferably, the refrigerator door further includes an auxiliary tank provided to the space between the inner case and the outer case to store the water supplied to the dispenser. And, the water supply tube is connected to the dispenser via the auxiliary tank.

Preferably, the tube guide is formed of a same material of the foaming liquid.

Preferably, a plurality of spacing members are projected from a backside of the tube guide.

More particularly, a plurality of the spacing members are provided along a circumference of a lower surface of the tube guide. More preferably, a plurality of the spacing members have panel shapes with prescribed lengths, respectively and differ from each other in width.

Preferably, the ice making unit includes a splash-preventing means for preventing water to make the ice from being splashed if the refrigerator door is rotated.

Preferably, the ice making unit includes an ice making receptacle having an ice making space for holding the water to make the ice, an assembling part extending from one side of the ice making receptacle to be fixed to the fixing unit, an ice transferring lever revolving to externally draw the ice made in the ice making receptacle, and a drive unit provided to one side of the ice making receptacle to have a motor driving the ice transferring lever and a case accommodating the motor. And, the splash-preventing means includes a guide part recessed with a prescribed depth into one side of the case of the drive unit in the vicinity of the ice making receptacle.

More preferably, the guide part is recessed into the one side of the case to have a downwardly tapering shape. More preferably, a circumference of the guide part is configured to have a shape of a looped curve.

More preferably, the guide par is provided to the one side of the case to have a shape of a rotor blade.

More preferably, the ice transferring lever is rotatably connected to a loading boss provided to the case and the guide part is configured to have a shape tapering toward the loading boss.

More preferably, the fixing unit includes a supporter fixed to the space between the outer case and the inner case and a supporter holder assembled to one side of the supporter to be connected to the assembling part of the ice making unit by a bolt penetrating the inner case. More preferably, the refrigerator door further includes a guide bracket provided to the other side of the supporter to guide a plurality of wires connected to the ice making unit. In this case, an opening is provided to the inner case and the guide bracket is projected via the opening to guide a plurality of the wires to the ice making unit.

More preferably, the supporter holder includes a locking portion including a boss having the bolt locked thereto and a fixing portion outwardly extending from the locking portion to adhere closely to an inner side of the inner case. More preferably, the supporter holder further includes a fixing protrusion protruding from an end portion of the fixing portion in a direction opposite to the inner side of the inner case.

More preferably, the ice making unit is provided to an ice making room provided to the backside of the inner case. And, the refrigerator door further includes an insulation duct provided to the one side of the inner case configuring the ice making room to guide cold air flowing to an inside/outside of the ice making room. In this case, the insulation duct is formed of an insulation material.

More preferably, the insulation duct includes a cold air supply passage provided to one side of the insulation duct to introduce the cold air of the refrigerator into the ice making room by communicating with a cold air supply duct supplying the cold air of the refrigerator if the refrigerator door is closed and a cold air discharge passage provided to the other side of the insulation duct to discharge the cold air of the ice making room to the refrigerator by communicating with a cold air discharge duct discharging the cold air of the ice making room if the refrigerator door is closed. And, the insulation duct further includes a support bracket provided to an end portion of each of the cold air supply and discharge passages of the insulation duct opposing the inner case to prevent breakage of the insulation duct. In this case, a mounting portion is further provided to an outer circumference of each of the cold air supply and discharge passages of the insulation duct to be recessed into a corresponding shape enabling the support bracket to be mounted thereon and a vertically bent fixing portion is provided to each side of the support bracket to be fixed to the mounting portion. And, a gasket is provided to the inner case corresponding to a position of the corresponding support bracket to prevent leakage of the cold air by adhering closely to each of the cold air supply and discharge ducts if the refrigerator door is closed.

In this case, the gasket includes an elastic portion formed of an elastic material to selectively come into compressive contact with the cold air supply duct or the cold air discharge duct of the refrigerator and a fitting portion provided along an outer circumference of the elastic portion to be fitted into the support bracket by penetrating the inner case.

More preferably, at least one gasket fitting hole is provided to the support bracket and at least one fitting protrusion is provided to an outer side of the fitting portion of the gasket to be fitted into the at least one gasket fitting hole.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 4:
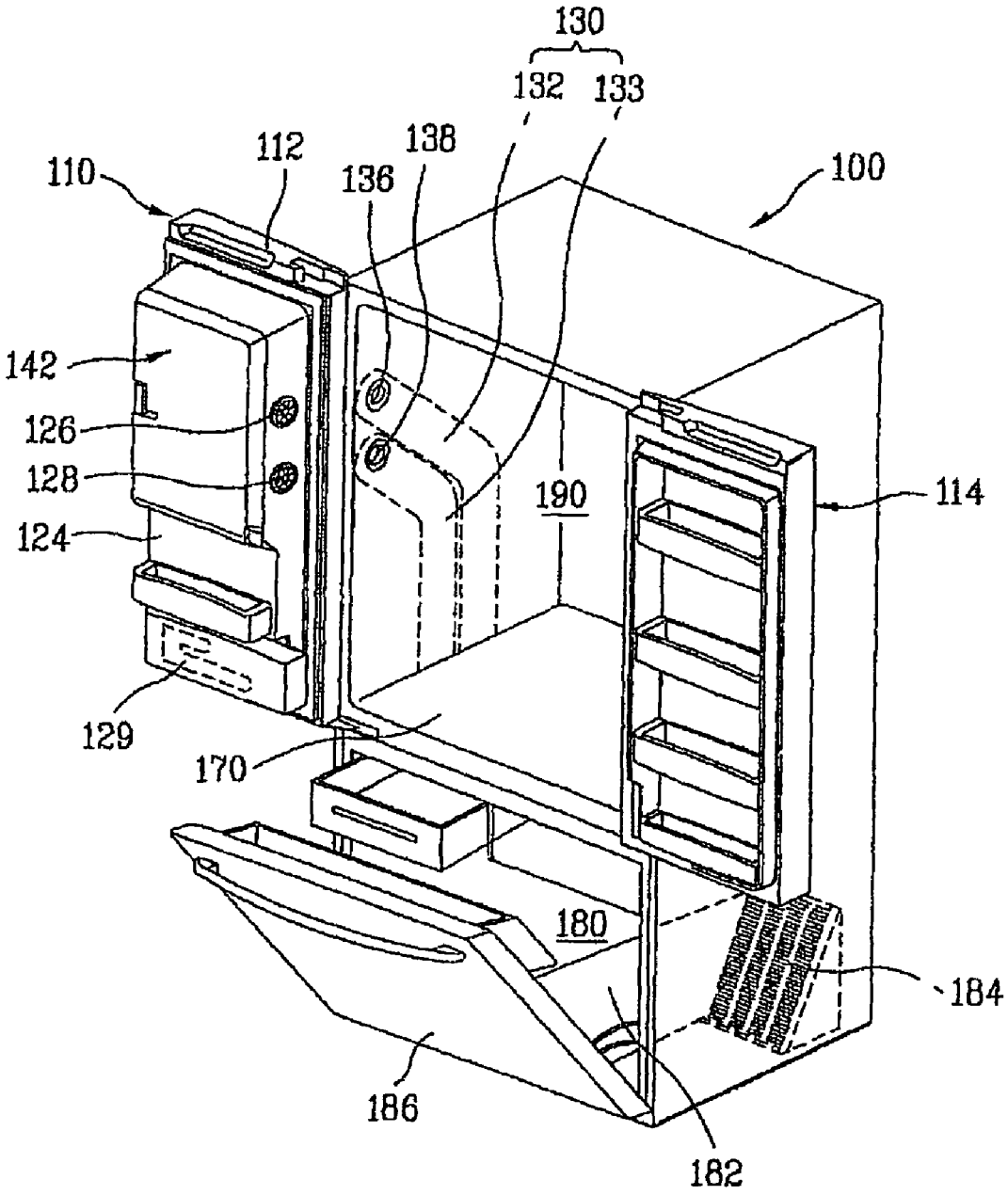
FIG. 4 is a perspective diagram of a refrigerator provided with a refrigerator door according to the present invention.

FIG. 4 is a perspective diagram of a refrigerator provided with a refrigerator door according to the present invention.

Referring to FIG. 4, a refrigerator body 100 has a rectangular box shape of which front side is selectively open. An inside of the body 100 is partitioned into an upper part and a lower part by a partition wall 170 to configure a cold storage room 190 and a freezer room 180, respectively.

And, refrigerator doors 110, 114 and 186 are provided to the open front side of the body 100, i.e., open front sides of the cold storage room 190 and the freezer rooms 180. The refrigerator doors 110, 114 and 186 include cold storage doors 110 and 114 selectively opening/closing the cold storage room 190 and a freezer room door 186 selectively opening/closing the freezer room 180.

Figure 1:
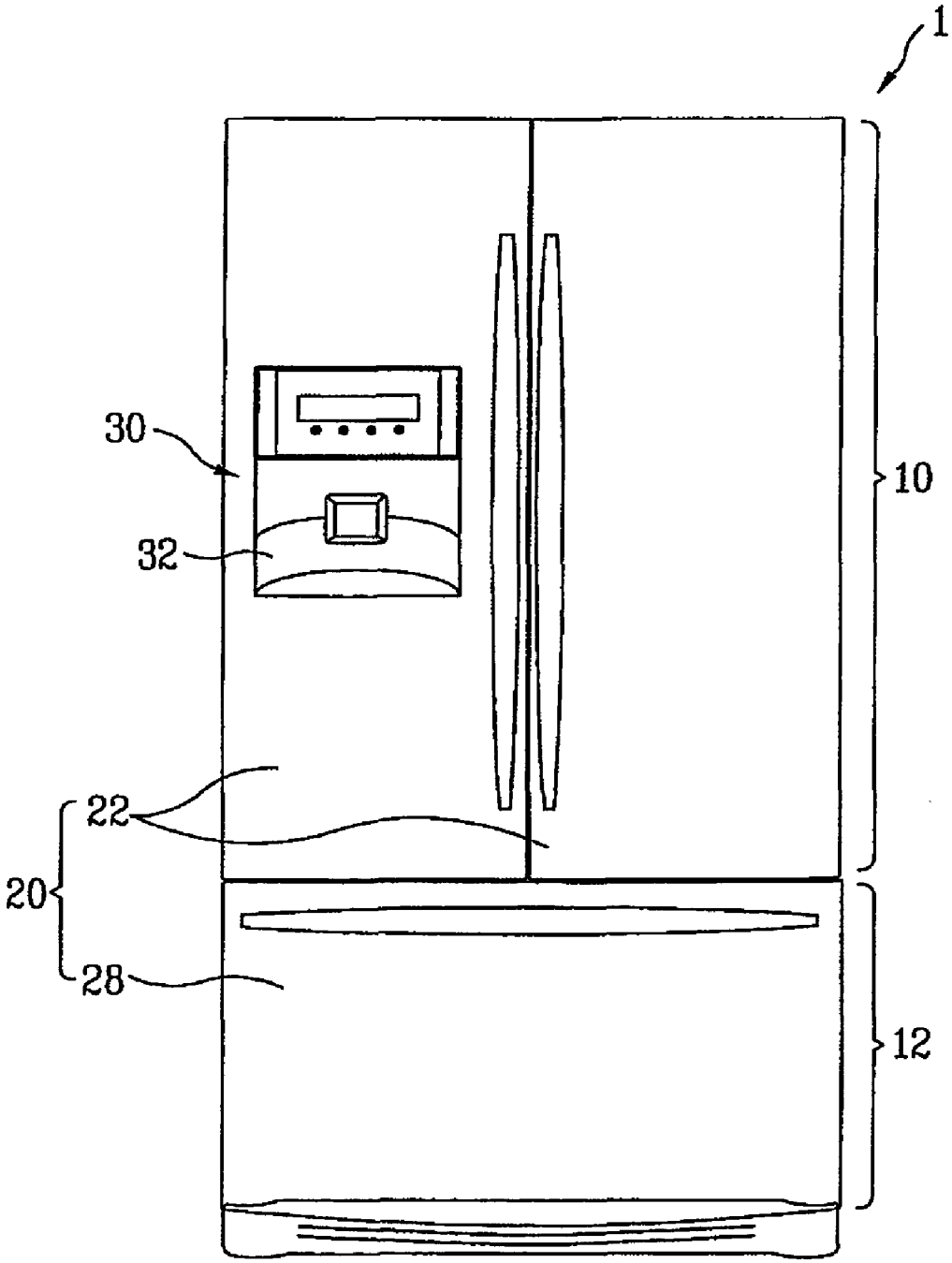
FIG. 1 Prior Art
FIG. 1 is a front diagram of a refrigerator according to a related art.
Figure 2:
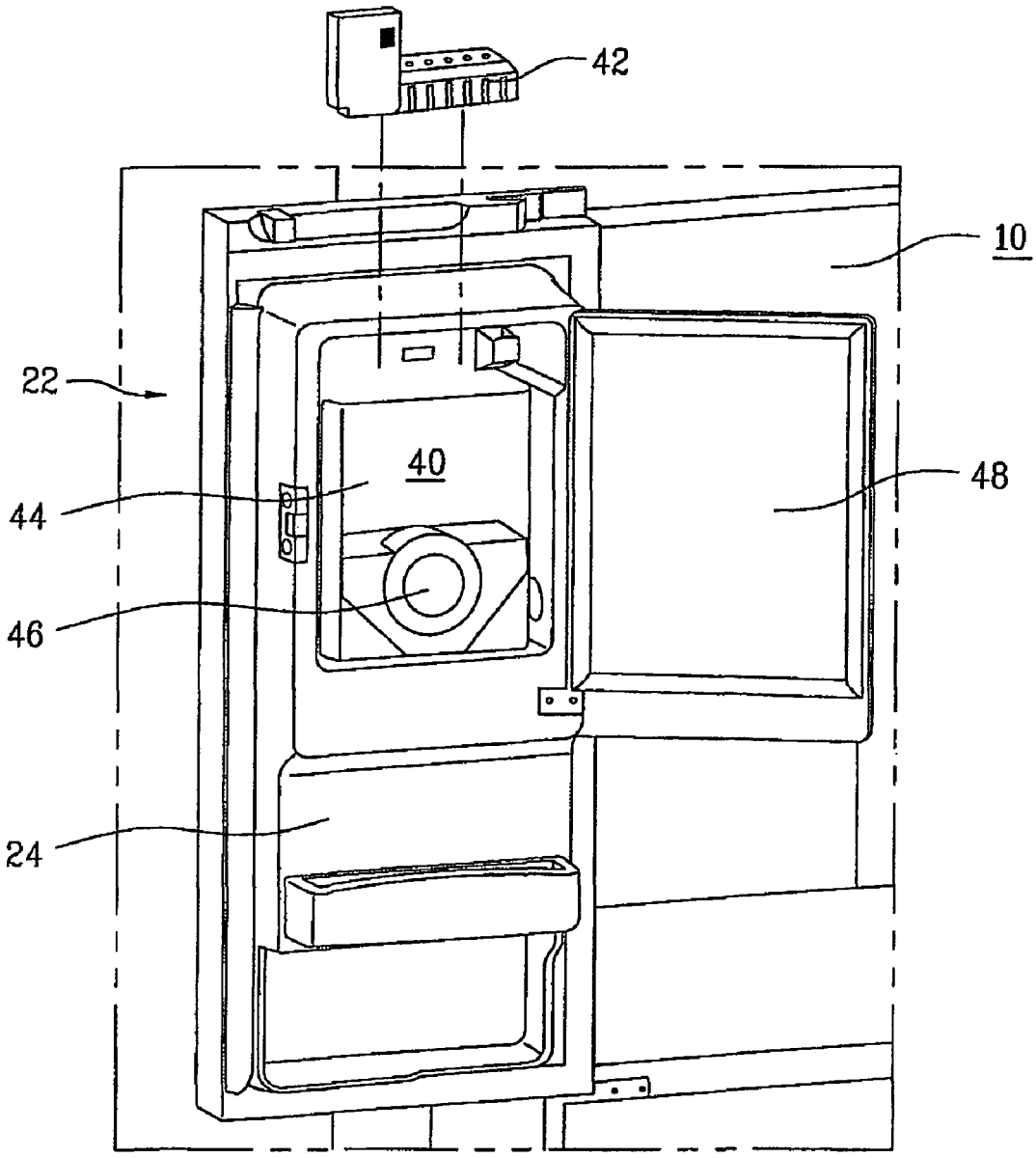
FIG. 2 Prior Art
FIG. 2 is a perspective diagram of a refrigerator door according to a related art, in which a backside of the refrigerator door is shown.
Figure 3:
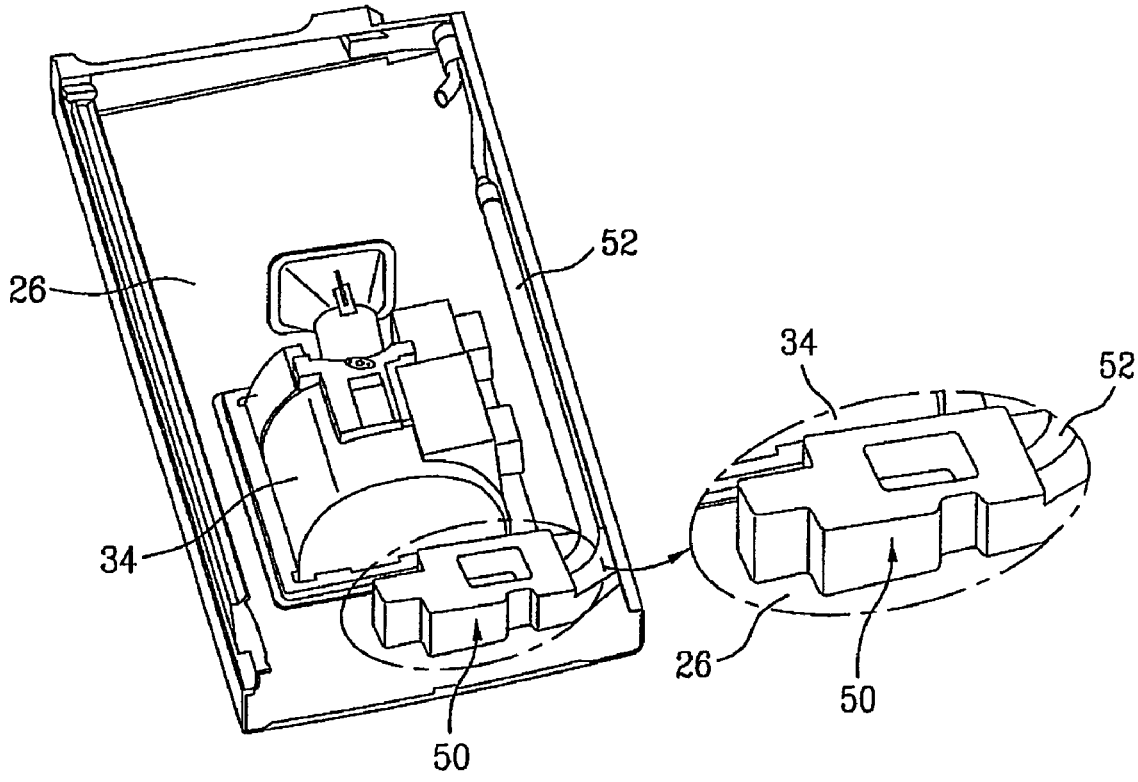
FIG. 3 Prior Art
FIG. 3 is a perspective diagram of the refrigerator door shown in FIG. 2, in which an inner configuration of the refrigerator is shown.

Meanwhile, one of the refrigerator doors 110 and 114 at left and right sides of the body 100 is provided with an ice making room (cf. FIG. 8) 140, in which an ice making unit (cf. FIG. 8) 200 making ice is installed, and a dispenser (cf. '30' in FIG. 1) enabling ice made by the ice making unit 200 and purified water to be taken out without opening the corresponding refrigerator door. And, the ice making unit 200 will be explained in detail later.

An auxiliary tank 129 is provided to a lower part of the refrigerator door 110. The auxiliary tank 129 is to temporarily store purified water supplied from outside. And, the auxiliary tank 129 is configured to have a size enough to continuously supply cool water even if a user keeps drawing water via the dispenser 30. And, a pump and valve (not shown in the drawing) are provided to one side of the refrigerator door 110 in the vicinity of the auxiliary tank 129.

As mentioned in the foregoing description, the freezer room 180 is provided under the cold storage room 190, and more particularly, to the lower part of the body 100 as a separate space partitioned from the cold storage room 190. And, the freezer room door 186 is provided to the open front side of the freezer room 180 to selectively open/close an internal space of the freezer room 180.

A freezer room evaporator 184 is provided in rear of the freezer room 180. The freezer room evaporator 184 generates cold air to cool down air within the freezer room 180 through heat exchange between a refrigerant flowing within the freezer room evaporator 184 and inner air of the freezer room 180. Besides, the cold air generated by the freezer room evaporator 184 is introduced into the cold storage room 190 by a separately provided blowing fan, damper and the like (not shown in the drawing) to keep the refrigerator at temperatures suitable for cold and frozen storages.

Meanwhile, the cold air generated by the freezer room evaporator 184 is guided to the ice making room 140 via a cold air duct 130 in part.

In particular, in case that the refrigerator door 110 is closed, the ice making room 140 is configured to communicate with the cold air duct 130 built within a sidewall of the cold storage room 190. Namely, the cold air duct 130 plays a role as a passage enabling the cold air of the freezer room 180 to be supplied to the ice making room 140 by having the ice making room 140 communicate with one side of the freezer room 180 in the vicinity of the evaporator 184. And, the cold air duct 130 is built within a left sidewall of the cold storage room 190.

The cold air duct 130 includes a cold air supply duct 132 transferring cold air to an inside of the ice making room 140 and a cold air discharge duct 133 transferring cold air used in making ice to the freezer room 180 from the ice making room 140. And, the cold air supply duct 132 and the cold air discharge duct 133 are provided to an inner sidewall of the cold storage room 190 in parallel to each other.

End portions (not shown in the drawing) of the cold air supply and discharge ducts 132 and 133 are open to communicate with one side of the freezer room 180 provided with the evaporator 184. The other open end portions of the cold air supply and discharge ducts 132 and 133 are exposed to the inner left sidewall of the cold storage room 190 to configure a duct inlet 136 and a duct outlet 138, respectively.

The duct inlet 136 is configured to supply cold air to the inside of the ice making room 140 by communicating with a supply passage 410 of an insulation duct (cf '400' in FIG. 12) that will be explained later. And, the duct outlet 138 is configured to discharge the cold air used in making ice from the ice making room 140 by communicating with a discharge passage 412 of the insulation duct 400.

Figure 5:
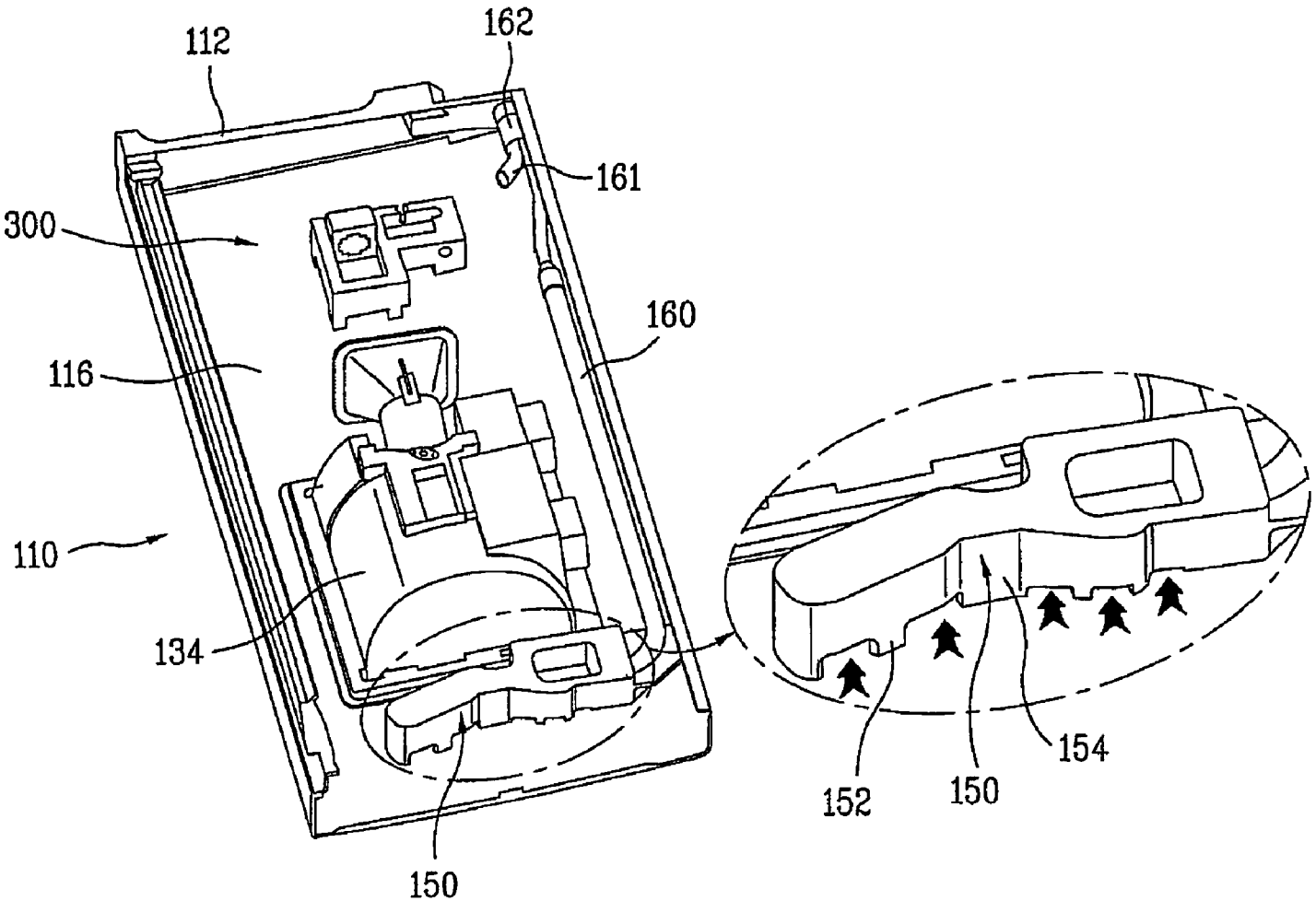
FIG. 5 is a perspective diagram of the refrigerator door shown in FIG. 4, in which an inner configuration of the refrigerator is shown.

FIG. 5 is a perspective diagram of the refrigerator door shown in FIG. 4, in which an inner configuration of the refrigerator is shown.

Referring to FIG. 5, a shape of a refrigerator door 110 is formed by an outer case 116.

A dispenser case 134 configuring an inner shape of a dispenser (cf. '30' in FIG. 1) is assembled to a backside of the outer case 116. The dispenser case 134 is configured to have a rectangular opening at a front side of the refrigerator door 110 and is recessed and rounded toward a backside portion of the refrigerator door 110 to form a space facilitating ice or water to be drawn using a cup or receptacle.

A hinge hole 162, at which the refrigerator door 110 is hinge-coupled, is provided to one side end of a cap deco 112 forming an upper exterior of the refrigerator door 110 by being assembled to a topside of the outer case 116. And, water supply tubes 160 and 161 enter the refrigerator door 110 via the hinge hole 162.

The water supply tubes 160 and 161 diverge from each other within the refrigerator door 110. The former water supply tube 161 extends to an inside of an ice making room (cf. '140' in FIG. 8) to supply water used in making ice. And, the latter water supply tube 161 extends downward to supply water to an auxiliary tank (cf. '129' in FIG. 4).

Meanwhile, a tube guide 150 is provided under the dispenser case 134. The tube guide 150 supports the water supply tube 160 extending to the auxiliary tank 129 or the dispenser 30. In case that an inner space of the refrigerator 110 is filled up with a foaming liquid in assembling the refrigerator door 110, the tube guide 150 is able to support the water supply tube 160 to be fixed thereto without movement. And, the tube guide 150 is also able to support and guide wires that connect electric parts including a pump (not shown in the drawing), a valve (not shown in the drawing) and the like.

Preferably, the tube guide 150 is formed of the same material of the foaming liquid (cf. '13' shown in FIG. 13) with which the inner space of the refrigerator door 110 is charged for insulation of the cold storage room 190. And, the tube guide 150 is formed prior to the charging of the foaming liquid 118 and is then assembled within the refrigerator door 110.

A plurality of spacing members 152 and 154 are formed on a backside of the tube guide 150. The spacing members 152 and 154 enable the tube guide 150 to be spaced with a prescribed gap apart from one side of the refrigerator door 110, and more particularly, from the backside of the outer case 116.

In particular, the spacing members 152 and 154 are provided along a circumference of the backside of the tube guide 150. Each of the spacing members 152 and 154 has a panel shape with a prescribed length and its lower end is installed at the backside of the outer case 116.

So, the tube guide 150 is installed to be spaced with the length of the corresponding spacing member 152 or 154 apart from the backside of the outer case 116. Preferably, a plurality of the spacing members 152 and 154 are provided along the circumference of the backside of the tube guide 150 with different gaps, respectively.

And, a plurality of the spacing members 152 and 154 can have various shapes, respectively. In particular, each of the spacing members 152 and 154 has a small rectangular panel shape having a prescribed length and its upper and lower ends are configured to come into contact with the backsides of the tube guide 150 and the outer case 116, respectively.

Meanwhile, a plurality of the spacing members 152 and 154 differ from each other in width.

In particular, a width of the spacing member 154 provided to a part having relatively great resistance by the foaming liquid in charging the inside of the refrigerator door 110 is formed relatively longer than the other to enable the tube guide 150 to be stably installed. And, a width of the spacing member 152 provided to a part having a relatively smaller resistance is formed relatively shorter than the former.

Preferably, a width of the spacing member 152 or 154 provided to a corner or gap is formed relatively short to enable the foaming liquid to smoothly flow between a space between the backside of the tube guide 150 and the backside of the outer case 116. Preferably, the spacing members 152 and 154 provided to a corner or gap are spaced with a relatively large gap apart from each other to enable the foaming liquid to smoothly flow between a space between the backside of the tube guide 150 and the backside of the outer case 116.

Figure 6:
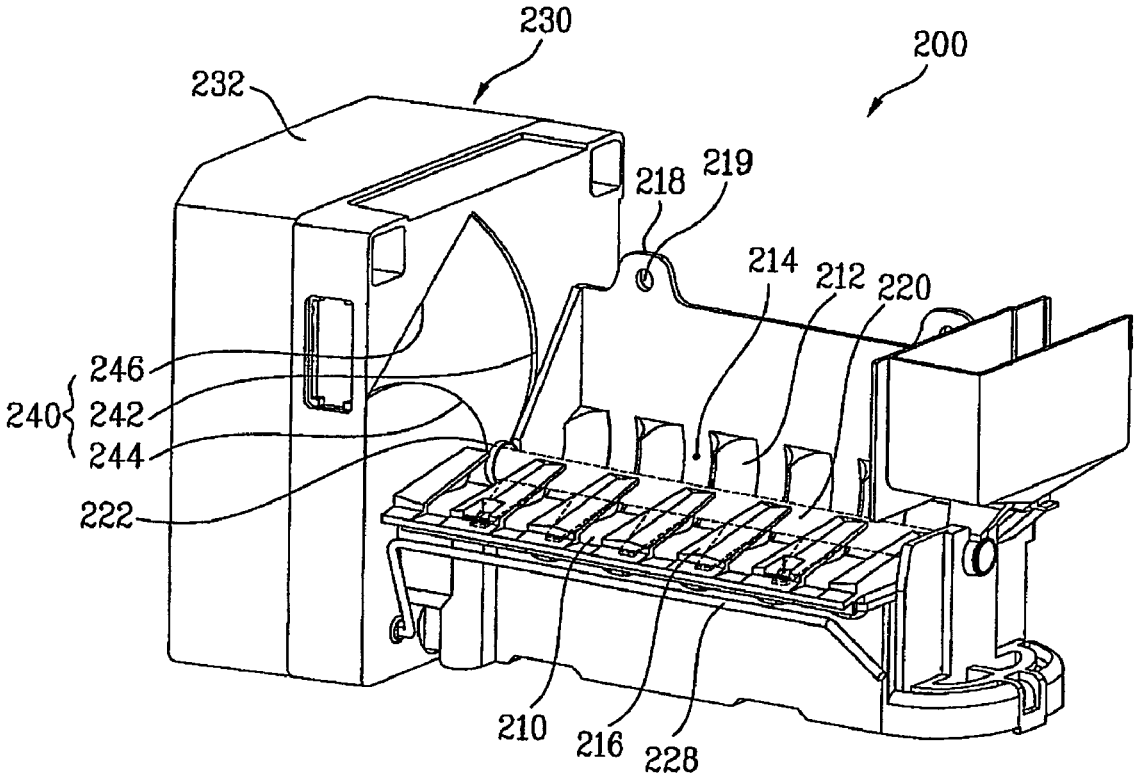
FIG. 6 is a perspective diagram of an ice making unit provided to the door shown in FIG. 4.

FIG. 6 is a perspective diagram of an ice making unit provided to the door shown in FIG. 4. And, FIG. 7 is another perspective diagram of the ice making unit shown in FIG. 6, in which an ice transferring lever 220 is removed.

Figure 7:
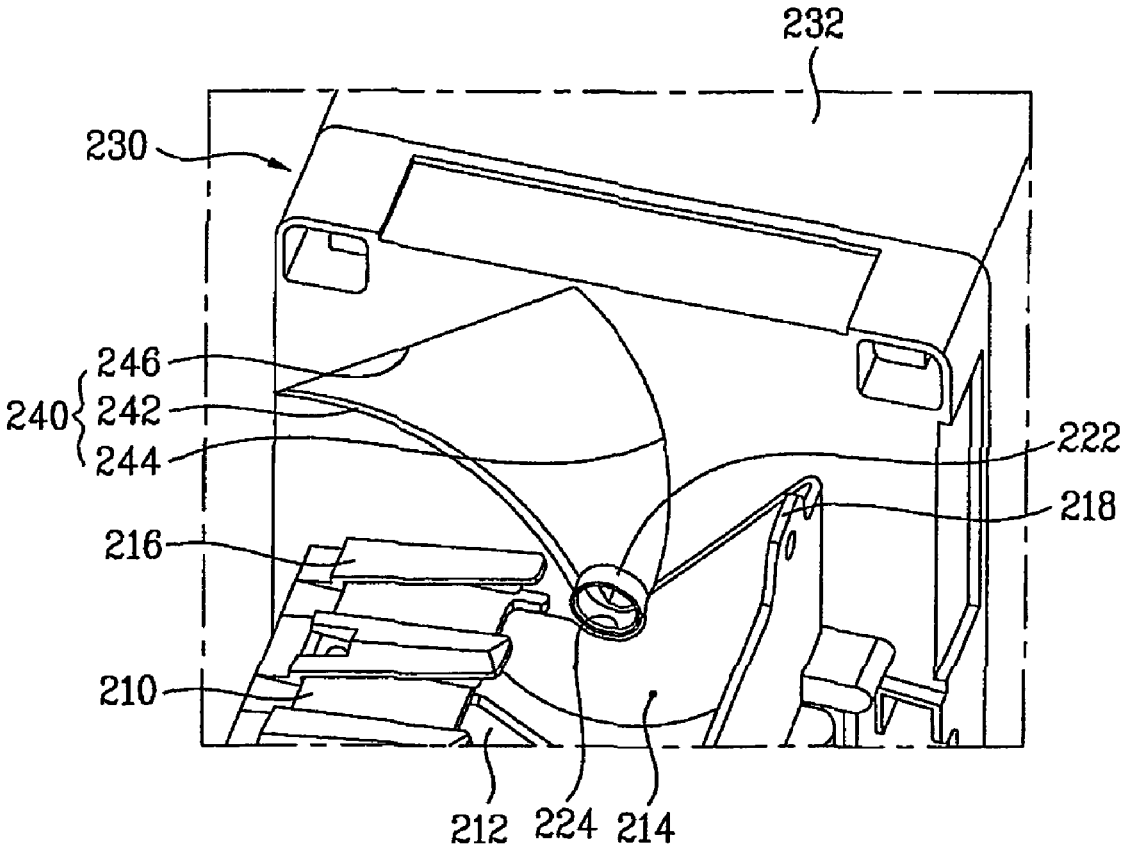
FIG. 7 is another perspective diagram of the ice making unit shown in FIG. 6.

Referring to FIG. 6 and FIG. 7, an ice making unit 200 includes an ice making receptacle 210 having an ice making space 214 holding water to make ice, an assembling part 218 extending from one side of the ice making receptacle 210, an ice transferring lever 220 revolving to draw the made ice from the ice making receptacle 210 and a drive unit 230 provided to one side of the ice making receptacle 210 and having a case 231 accommodating a motor (not shown in the drawing) driving the ice transferring lever 220 and the like.

The ice making receptacle 210 makes ice using water supplied via the water supply tube (cf. '161' in FIG. 5). In particular, a plurality of partitions 12 are provided within the ice making receptacle 210 to divide the ice making space 214 within the ice making receptacle 210 into a plurality of partitions. In this case, a plurality of the partitions 212 play a role in separating the ice made in the ice making space 214 into small units smoothly.

Meanwhile, a stripper 216 is provided to a topside of the ice making receptacle 210. The stripper 216 includes a plurality of long and narrow ribs spaced apart from each other. The stripper 216 plays a role in enabling the ice made in the ice making receptacle 210 to correctly drop into an ice storage container (not shown in the drawing) under the ice making receptacle 210. Besides, a heater (not shown in the drawing)

can be provided under the ice making receptacle 210 to facilitate the complete ice to be detached from the ice making receptacle 210.

Meanwhile, the assembling part 218 is configured to upwardly extend from one sidewall of the ice making receptacle 210. The coupling part 218 is assembled to one side of the refrigerator door 110 to enable the ice making unit 200 to be assembled to the refrigerator door 110.

The drive unit 230 is provided to one side of the ice making receptacle 210. A case 232 configures a shape of the drive unit 230. And, drive and control devices (not shown in the drawing) controlling operations of the ice making receptacle 210 are installed within the drive unit 230.

A loading boss 222 is projected from one side of the case 232. A passing hole (cf. FIG. 7) 224 is provided to the loading boss 222. And, one end of the ice transferring lever 220 is fitted into the passing hole 224 to be connected to the drive device provided within the drive unit 230. Besides, as an outer circumference of the loading boss 222 is circular, the water splashed on a guide part 240 is introduced into the ice making space 214 via the outer circumference of the loading boss 222.

The guide part 240 is configured to be recessed into one lateral side of the case in the vicinity of the ice making receptacle 210. The guide part 240 is placed above the loading boss 222 and has a downwardly tapering shape. In particular, the guide part 240 includes a first curved portion 242, a second curved portion spaced apart from the first curved portion 242 and a third curved portion 246 connecting end portions of the first and second curved portions 242 and 244 together.

The first and second curved portions 242 and 244 play a role in enabling the water splashed on the guide part 240 from the ice making receptacle 210 to move back to the ice making receptacle 210 without flowing down along the case 232 when a user turns the refrigerator door 110.

The third curved portion 246 connects the end portions of the first and second curved portions 242 and 244 together to enable the guide part 240 to have an overall shape of a looped curve. So, the third curved portion prevents the water splashed on the guide part 240 from the ice making receptacle 210 from moving above the guide part 240.

Besides, as mentioned in the foregoing description, a distance between the first and second curved portions 242 and 244 of the guide part 240 is configured to become reduced toward the loading boss 222. Preferably, the guide part 240 is able to have a shape of a rotor blade. The above-configured guide part 240 plays a role in introducing the water splashed on one side of the case 232 into the ice making space 214. In particular, the guide part 240 prevents the water from flowing down outside the ice making space 214 in a manner of guiding the water splashed on one side of the case 232 in a direction of the loading boss 222.

Meanwhile, one end of the ice transferring lever 220 is fitted into the passing hole 224 to be supported thereon. The ice transferring lever 220 is configured to rotate to draw the completely frozen ice from the ice making receptacle 210 using a rotational force of the drive motor (not shown in the drawings) provided within the drive unit 230.

And, an ice detecting lever 228 is rotatably provided to one side of the case 232 to detect whether the ice storage container (not shown in the drawings), which is provided under the ice making receptacle 210, is filled up with the ice.

Figure 8:
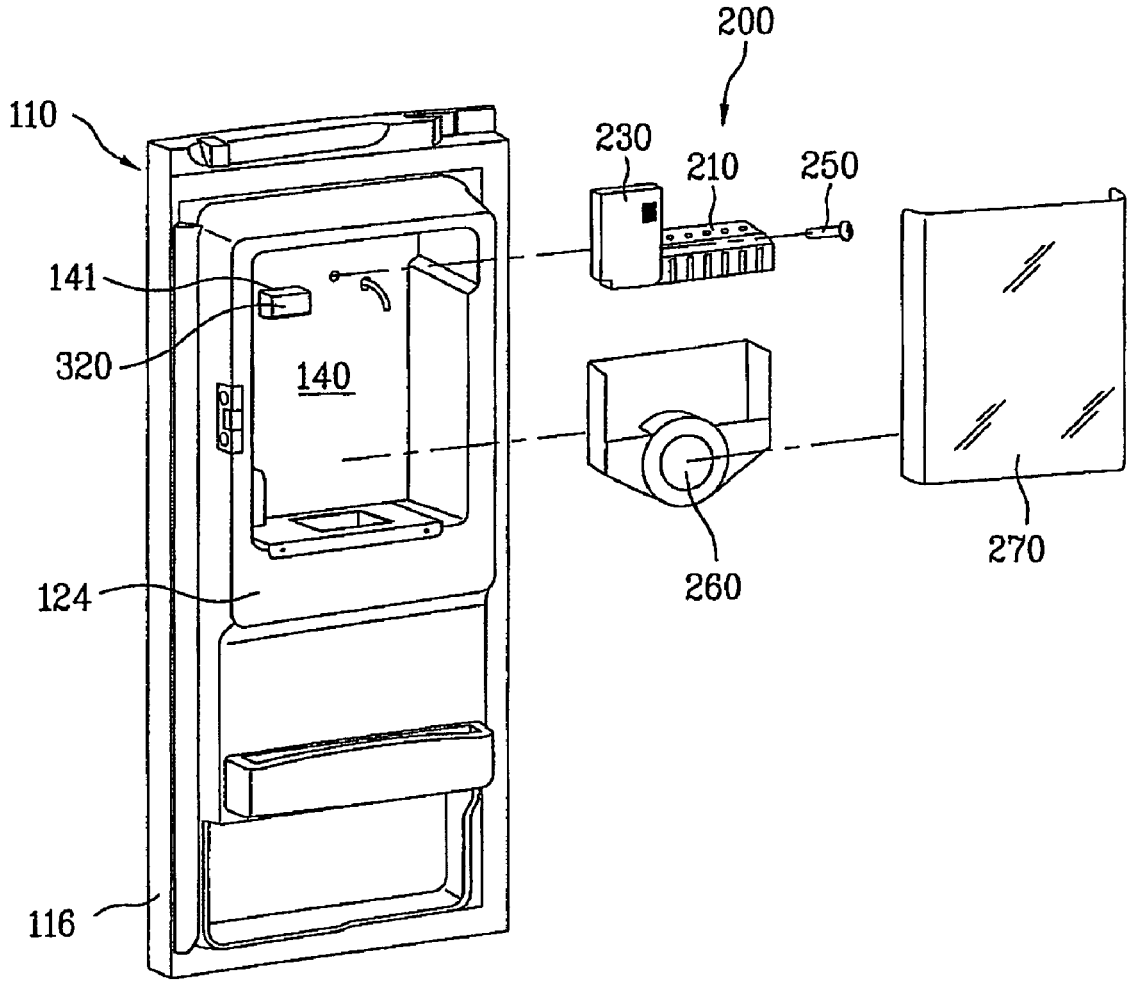
FIG. 8 is an exploded perspective diagram of an ice making unit assembled to an ice making room of the refrigerator door shown in FIG. 4.

FIG. 8 is an exploded perspective diagram of an ice making unit 200 assembled to an ice making room of a refrigerator door according to the present invention.

Referring to FIG. 8, an upper part of an inner case 124 forming a backside of a refrigerator door 110*a* is recessed to configure a shape of an ice making room 140.

In particular, the inner case 124 forming a shape of the backside of the refrigerator door 110 provides a recessed space having an about rectangular shape on the upper part of the backside of the refrigerator door 110 to be projected along sides of the door 10. Namely, the inner case 124 is configured to be projected along the sides of the door 110 on the backside of the refrigerator door 110 in a front direction of FIG. 8. And, an inside of the projected portion is recessed in a rear direction of FIG. 8 to configure a space of the ice making room 140.

The aforesaid receptacle 200, an ice bank 270 and a transferring device 260 are loaded in the space of the ice making room 140 configured by the inner case 124.

The ice made by the ice making unit 200 is temporarily stored in the ice bank 270 and is then supplied to the dispenser (cf. '30' in FIG. 1) by the transferring device 260.

In particular, the ice bank 270 is provided between the ice making unit 200 and the transferring device 260. The ice bank 270 is provided to temporarily store the ice made by the ice making unit 200. The ice bank 270 having a panel shape configures a space for the storage to cut off a space between the ice making unit 200 and the transferring device 260. And, the ice bank 270 is assembled to the ice making room 140 by coming into contact with both inner sides of the ice making room 140 to be fitted in-between. Alternatively, the ice bank 270 can be built in one body of the transferring device 260 to be loaded in the ice making room 140.

The transferring device 260 is installed under the ice making receptacle, and more particularly, at a lower part of the ice making room 140. The transferring device 260 is provided to supply the ice made by the ice making device 200 to the dispenser 30. And, a DC motor (not shown in the drawing) and various devices (not shown in the drawing) for guide are provided within the transferring device 260 to supply a specific quantity of the ice. In this case, the transferring device 260 is loaded in the lower part of the ice making room 140 in a manner that a lower side, a rear side and both lateral sides of the transferring device 260 come into contact with inner sides of the ice making room 140, i.e., 24. And, the transferring device 260 is installed to be loaded in the lower part of the ice making room 140.

Meanwhile, the ice making unit 200 is locked to a fixing unit 300 (explained later) of the ice making room 140 by a bolt 250 without a separate support structure. And, the fixing unit 300 is explained in detail as follows.

Figure 9:
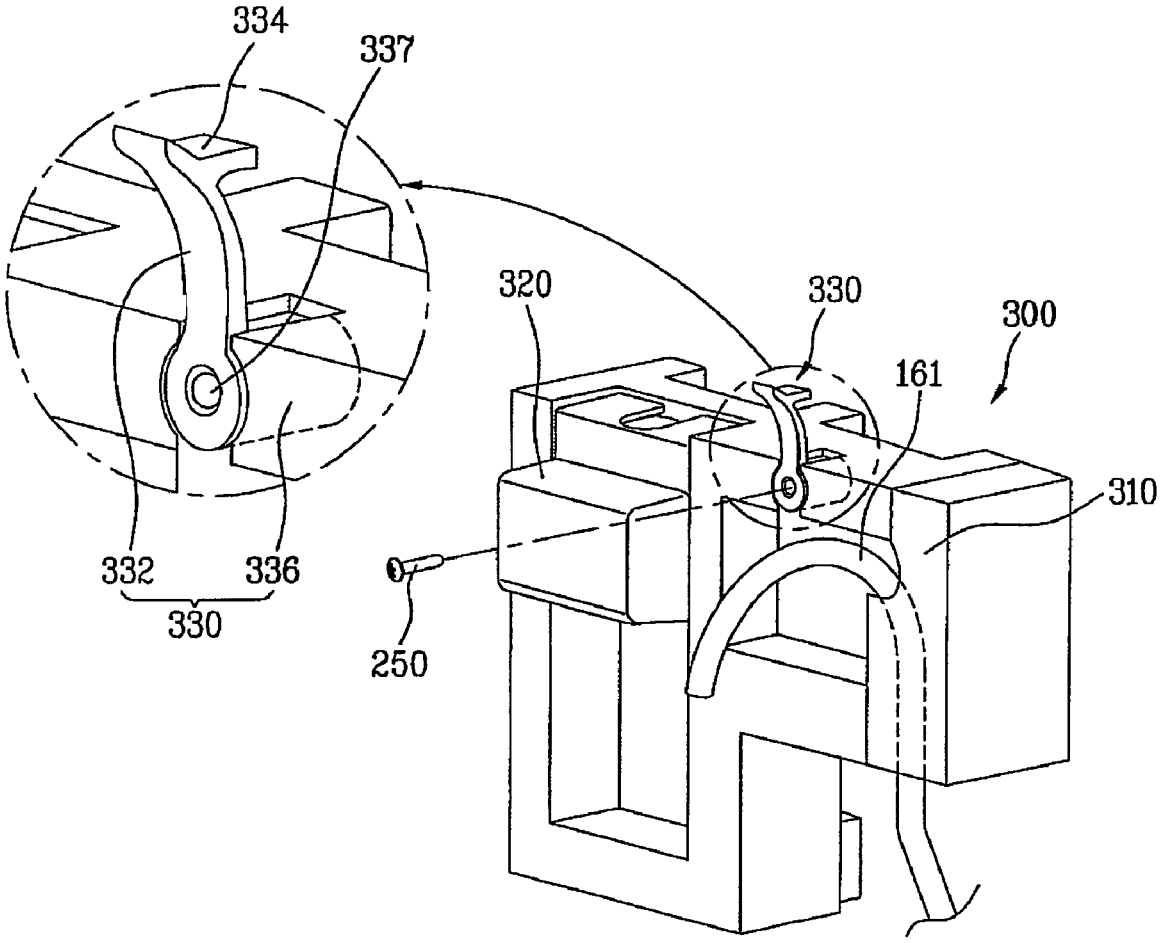
FIG. 9 is a perspective diagram of a fixing unit fixing the ice making unit of FIG. 8 to the door.

FIG. 9 is a perspective diagram of a fixing unit fixing an ice making unit in a refrigerator door according to the present invention.

Referring to FIG. 9, a fixing unit 300 includes a supporter 310 fixed between an outer case (cf. '116' in FIG. 8) and an inner case (cf. '124' in FIG. 8) and a supporter holder 330 assembled to one side of the supporter 310 to be connected to an assembling part (cf. '218' in FIG. 6) of an ice making unit 200 by a bolt 250 penetrating the inner case 124.

The supporter 310 is provided to assist the installation and operation of the ice making unit 200. The supporter 310 is previously formed of foaming polystyrene (EPS) and then installed at an inside of a refrigerator door 110, and more particularly, in the space between the outer case 116 and the inner case 124.

Figure 13:
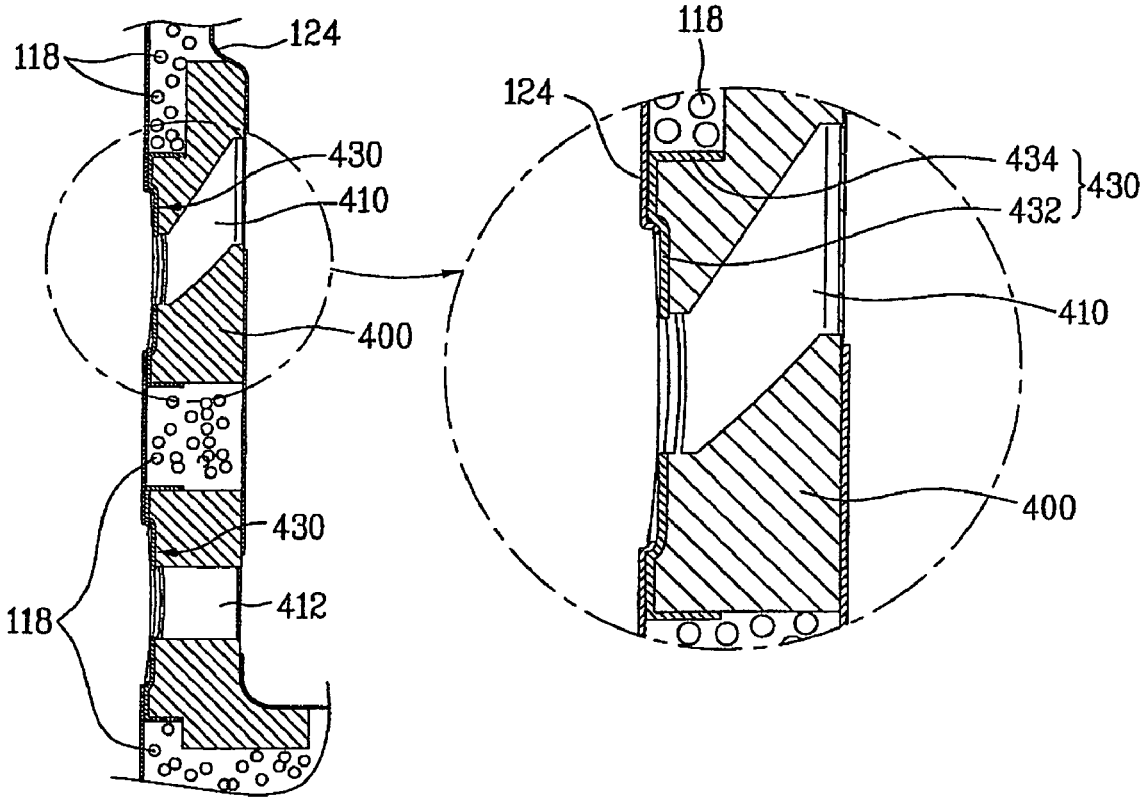
FIG. 13 is a cross-sectional diagram according to a cutting line XIII-XIII in FIG. 12.

In particular, the supporter 310 is loaded to be fixed to the space between the outer case 116 and the inner case 124 prior to the charging of the foaming liquid (cf. '118' in FIG. 13). And, the supporter 310 is configured to have the same height of the gap between the outer case 116 and the inner case 124 to be fixed within the refrigerator door 110.

The supporter has an uneven shape at its bottom side coming into contact with the outer case 116 to enable the foaming liquid 118 to charge the inside of the uneven shape of the supporter 310 in case of injecting the foaming liquid 118. By the charging of the foaming liquid 118, the supporter 310 can be completely fixed not to move.

The supporter 310 is built within a position corresponding to an upper part of the ice making room 140 to assist the loading of the ice making unit 200. For this, the supporter 310 is provided with a guide bracket 320 and a supporter holder 330.

The guide bracket 320 is formed by plastic injection molding to have a multiply bent bracket shape to play a role in guiding a plurality of wires that supply power for the operation of the ice making unit 200 and carry signals for controlling the operation of the ice making unit 200.

The guide bracket 320 is loaded to be fixed by being fitted into an upper part of the supporter 310 formed by foaming to have a shape corresponding to the guide bracket 320. After the guide bracket 320 has been loaded, the supporter 30 can be assembled to the inside of the door 110.

Meanwhile, one side of a connector (not shown in the drawing), which is connected to end portions of a plurality of wires, is provided to one side of the guide bracket. And, the connector (not shown in the drawing) is combined with pins (not shown in the drawing) correspondingly provided to one side of the ice making unit 200 to enable electrical connections for the operation of the ice making unit 200. To enable the connections to the pins at one side of the ice making unit 200, one side of the guide bracket 320, and more particularly, the connector loaded part can be projected to be externally exposed. An opening 141 is provided to one side of the inner case corresponding to the guide bracket 320. And, it is able to load the guide bracket 320 to expose one side of the guide bracket 320 via the opening 141.

Meanwhile, the supporter holder 330 is attached to one side of the supporter 310. The supporter holder 330 is provided to be coupled with the bolt 250 locked to assemble the ice making unit 200. And, the supporter holder 330 is fitted into one side of the supporter 3110 corresponding to a position to be locked by the bolt 250.

The supporter holder 330 includes a locking portion 336 and a fixing portion 332.

The locking portion 336 is provided for the locking of the bolt 250. The locking portion 336 has a cylindrical shape with a prescribed height. And, a boss 337, to which the bolt 250 is locked, is provided to a middle part of the locking portion 336 to correspond to a shape of the bolt 250. Preferably, the locking portion 336 is configured to have the height corresponding to that of the supporter 310 to be completely fitted into the supporter 310. And, the locking portion 336 is loaded to expose the boss 337 at one side of the inner case 124 only.

The fixing portion 332 is configured to extend outwardly from one side of an upper end of the locking portion 336. And, the fixing portion 332 extends to be outwardly projected from the supporter 310.

The fixing portion 332 is configured to adhere closely to a backside of the inner case 124, and more particularly, to the backside of the inner case 124 opposing the outer case 116.

In particular, if the inner case 124 is bent to have a prescribed curvature for the close adherence to the ice making unit 200, the fixing portion 332 is bent to have the same curvature of the inner case 124. So, a topside of the fixing portion 332 is able to completely adhere to the backside of the inner case 124 to enable surface contact in-between. Hence, the supporter holder 330 can be prevented from moving freely.

A fixing protrusion 334 is provided to an end portion of the fixing portion 332. The fixing protrusion 334 is to fix a position of the supporter holder 330 by preventing the free movement of the supporter holder 330. The fixing protrusion 334 is configured to protrude from the end portion of the fixing portion 332 in a direction opposite to the backside of the inner case 124.

The fixing protrusion 334 is embedded in the foaming liquid 118 when the inside of the refrigerator door 110 is charged with the foaming liquid 118. So, the fixing protrusion 334 protrudes to have a length enough to be completely fixed by being embedded in the foaming liquid 118. Hence, as the position of the fixing portion 332 is fixed by the foaming liquid 118, the supporter holder 330 can be prevented from moving freely within the supporter 310 and from being loosened in locking the bolt 250.

A water supply tube 161 is provided to one side of the supporter 310 to supply water to the ice making unit 200. The water supply tube is provided to guide water supplied from outside of the refrigerator to the ice making unit 200. And, the water supply tube 161 is loaded in a manner that one end portion of the water supply tube 161 is externally exposed by penetrating the inner case 124.

Figure 10:
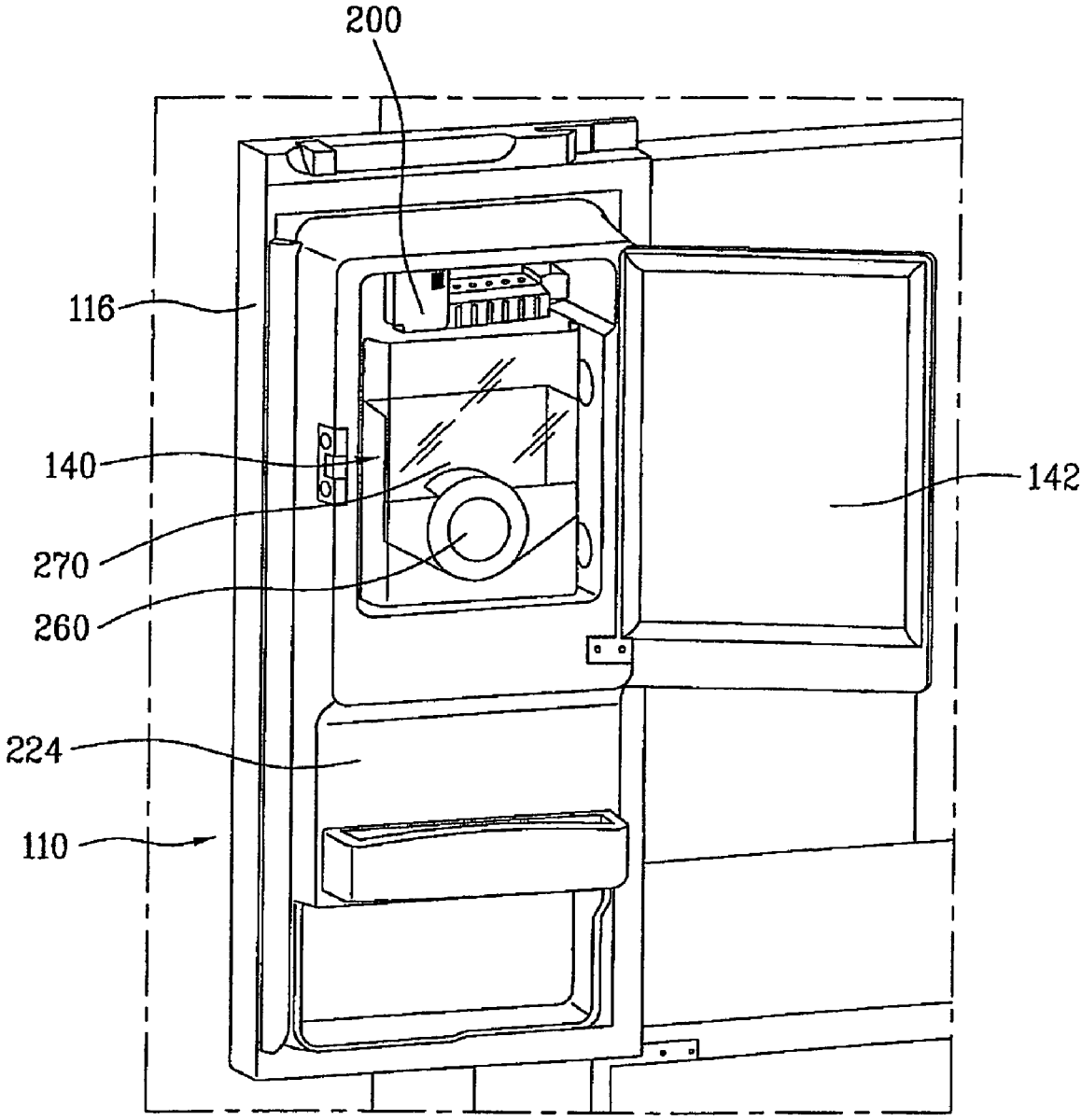
FIG. 10 is a perspective diagram of the ice making unit assembled to the door in FIG. 8.

FIG. 10 is a perspective diagram of a backside of a refrigerator door according to the present invention.

Referring to FIG. 10, as mentioned in the foregoing description, the ice making unit 200, the ice bank 270 and the transferring device 260 are provided within the ice making room 140.

Meanwhile, an inlet (cf. '126' in FIG. 4) as an entrance for supplying cold air from the cold air duct (cf. '130' in FIG. 4) and an outlet (cf. '128' in FIG. 4) as an exit for discharging the cold air from the ice making room 140 are configured to penetrate a right sidewall of the ice making room 140.

In this case, positions of the inlet and outlet 126 and 128 are provided to oppose positions of the right sidewall of the ice making room 140 coming into contact with the duct inlet and outlet (cf. '136' and '138' in FIG. 4) of the cold air duct (cf. '130' in FIG. 4), respectively in revolving the refrigerator door 110 to close. So, when the refrigerator door 110 is closed, the inlet and outlet 126 and 128 adhere closely to the duct inlet and outlet 136 and 138, respectively to communicate with each other.

Figure 11:
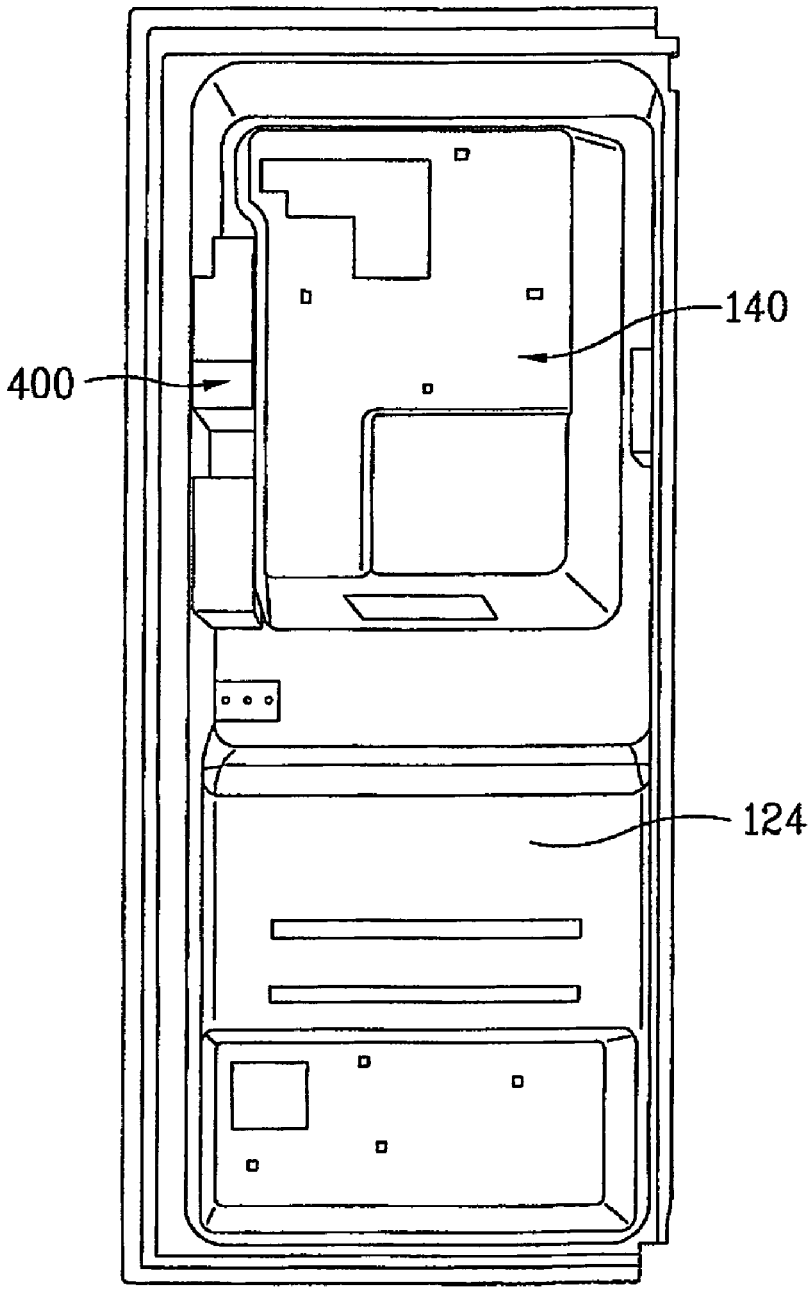
FIG. 11 is a diagram of a backside of an inner case configuring a backside of the door in FIG. 10.

FIG. 11 is a diagram of a backside of an inner case 124 in a refrigerator door according to the present invention.

Referring to FIG. 11, an insulation duct 400 is provided to one side of the inner case 124, and more particularly, to a position corresponding to a wall of the ice making room 140 coming into contact with the duct inlet (cf. '136' in FIG. 4) and the duct outlet (c. '138' in FIG. 4) of the cold air duct (cf. '130' in FIG. 4). In particular, the insulation duct 400, which is provided to guide the cold air between the cold air duct (cf. '130' in FIG. 4) provided to one side of the body 100 and the ice making room 140, is fitted into the backside of the inner case 124 provided with the inlet 126 and the outlet 128.

Figure 12:
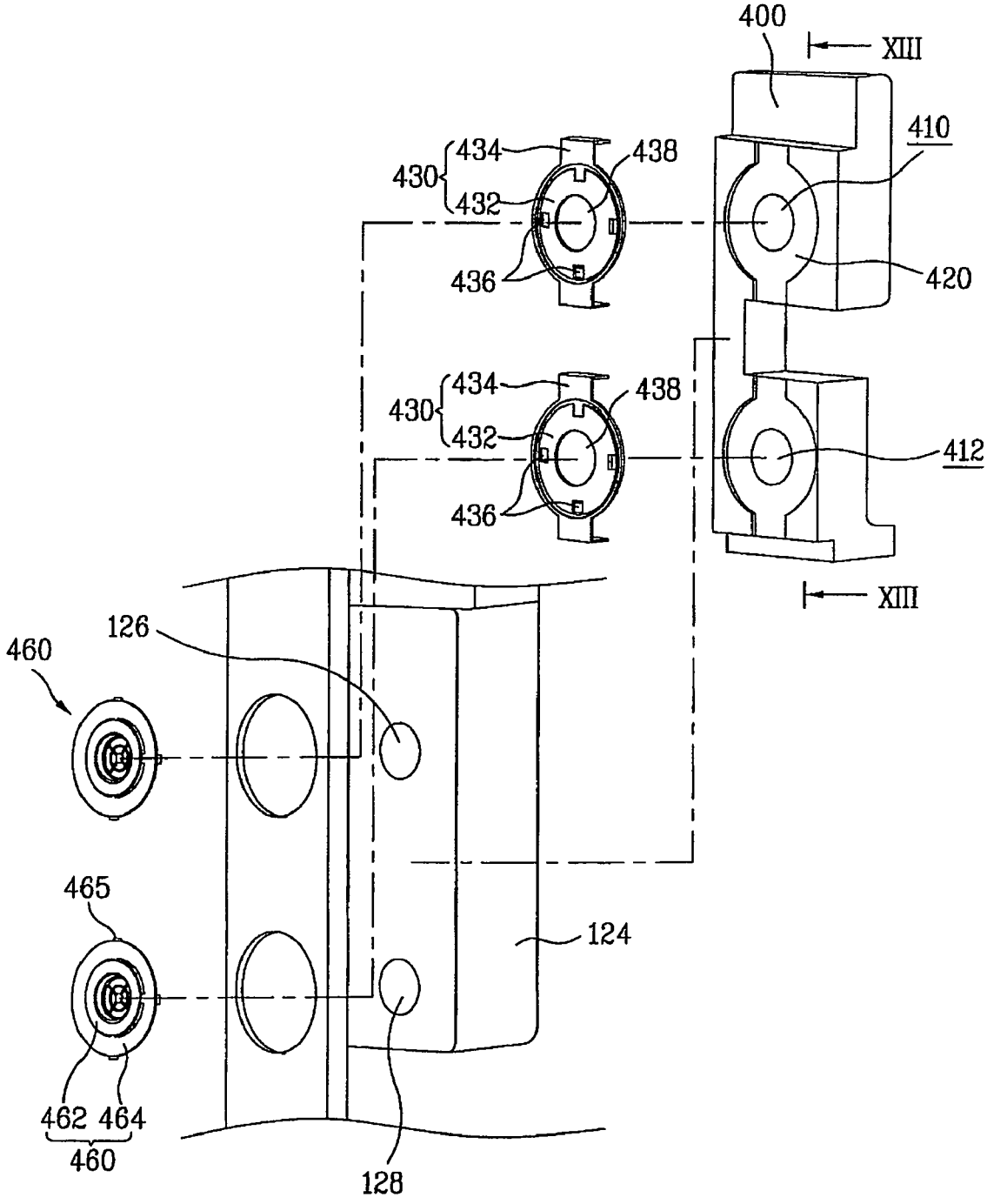
FIG. 12 is a perspective diagram of one side of an inner case configuring an ice making room in FIG. 10 and an insulation duct.

FIG. 12 is an exploded perspective diagram of an insulation duct provided to one side of an inner case 124 and FIG. 13 is a cross-sectional diagram according to a cutting line XIII-XIII in FIG. 12.

Referring to FIG. 12 and FIG. 13, an insulation duct 400 formed of an insulating material by molding is assembled to one side of an inner case (cf. FIG. 4) 124 corresponding to an outer side of an ice making room (cf. '140' in FIG. 4).

The insulation duct 400 is to secure a passage of cold air flowing between a cold air duct (cf. '130' in FIG. 4) and an ice making room 140 prior to charging a refrigerator door 110 with a foaming agent.

Preferably, the insulation duct 400 is configured to have a correspondent size and shape to be fitted into a recessed portion of the inner case 124.

And, the insulation duct 400 is formed of the same material of a foaming liquid 118 charged between an outer case 116 and the inner case 124 to insulate positions adjacent to the ice making room 140, and more particularly, to the inlet 126 and the outlet 128, thereby preventing the loss of cold air due to heat exchange.

Meanwhile, a cold air supply passage 410 and a cold air discharge passage 412 are provided to the insulation duct 400.

The cold air supply passage 410 is formed by perforation to enable an inside and an outside of the ice making room 140 to communicate with each other. The cold air supply passage 410 is configured to enable the cold air supplied via the cold air supply duct 132 to be introduced into the ice making room 140.

The cold air discharge passage 412 is provided below the cold air supply passage 410. Like the cold air supply passage 410, the cold air discharge passage 412 is formed by perforation to enable the inside and outside of the ice making room 140 to communicate with each other. And, the cold air discharge passage 142 is configured to enable the cold air, which is discharged from the ice making room 140 after having been used in making ice, to be discharged into the cold air discharge duct 133.

Preferably, openings of the cold air supply and discharge passages 410 and 412 are configured to match the inlet 126 and the outlet 128 provided to one side of the ice making room 140 in assembling the insulating duct 400 to the inner case 400.

Meanwhile, a mounting portion 420 is provided to one side of the insulation duct 400 coming into contact with the inlet 126 and the outlet 128.

The mounting portion 420 facilitates the installation and fixation of a support bracket 430. The mounting portion 420 is configured to be recessed inward to correspond to a shape of the support bracket 430. And, the mounting portion 420 is provided to each of the openings along outer circumferences of the cold air supply and discharge passages 410 and 412. In this case, the support bracket 430 is recessed inward by the thickness of the support bracket 430 in order that the support bracket 430 is not projected from one side of the insulation duct 400 is installing the support bracket 430.

The support bracket 430 is provided to prevent the insulation duct 400 from being transformed by external impact and the like and being detached from the inner case 124. The support bracket 430 is configured to have a plate shape to come into surface contact with the insulation duct 400. And, the support bracket 430 includes a circular fitting portion 432 and a fixing portion protruding and extending from both upper and lower sides of the fitting portion 432.

Preferably, the support bracket 430 is formed of plastic resin, which has rigidity better than that of the insulation duct 400 formed of the insulation material by foaming, by injection molding.

The fitting portion 432 is provided to reinforce rigidity of one portion of the insulation duct 400 by being fitted into each of the mounting portions 420 provided to the circumferences of the openings of the cold air supply and discharge passages 410 and 412 of the insulation duct 400, respectively. And, the fitting portion 432 is configured to have a circular shape of which diameter is greater than that of each of the cold air supply and discharge passages 410 and 412. An inside of the fitting portion 432 is configured to have a recessed shape overall. So, an outer circumference of the fitting portion 432 is projected upward.

A perforated hole 438 is provided to a center of the fitting portion 432 to have a same diameter of each of the openings of the cold air supply and discharge passages 410 and 412. And, the perforated hole 438 is configured to match the corresponding opening of the cold air supply passage 410 or the cold air discharge passage 412 in fitting the support bracket 430.

A plurality of gasket fitting holes 436 are provided to the fitting portion 432 outside the perforated hole 438. A plurality of the gasket fitting holes 436 provided to attach a gasket 460, which will be explained later, are formed at upper, lower, left and right sides of the perforated hole 438 by perforation, respectively.

Meanwhile, the fixing portions 434 are provided to upper and lower ends of the fitting portion 432 to be projected upward and downward, respectively.

The fixing portions 434 are provided to fix the corresponding support bracket 430. And, the fixing portions 434 are fitted into upper and lower portions of the mounting portion 429 recessed to correspond to the shape of the support bracket 430, respectively.

Each of the fixing portions 434 has a panel shape with a prescribed width and is configured to be vertically bent in a direction of the insulation duct 400 after having extended from an upper or lower end of the corresponding fitting portion 432 upwardly or downwardly by a prescribed length. In this case, the insulation duct 400 is projected to be surface-contactable with the extending and bent portions of each of the fixing portions 434. And, the fixing portions 434 adhere closely to corners of the upper and lower portions of the projected portion of the insulation duct 400 to enable the corresponding support bracket 430 to be fixed to the insulation duct 400.

Meanwhile, the inlet and outlet 126 and 128 having the openings are provided to one side of the inner case 124 corresponding to the positions of the support brackets 430, respectively. And, sizes of the inlet and outlet 126 and 128 are configured to correspond to those of the fitting portions 432 of the support brackets 430, respectively. And, inner circumferences (not shown in the drawings) of the inlet and outlet 126 and 128 are configured to be bent in directions of fitting the support brackets 430, respectively, whereby the fitting portions 432 having recessed outer circumferences can be interrupted by the inner circumferences of the inlet and outlet 126 and 128 of the inner case 124, respectively.

Hence, the support brackets 430 are mounted on the mounting portions of the insulation duct 400 to be fixed thereto, respectively and are interrupted by the inner circumferences of the inlet and outlet 126 and 128 of the inner case 124, respectively, thereby enabling the insulation duct 400 to be fixed overall.

Meanwhile, the gaskets 460 are attached to the inner case 124 into which the support brackets 430 are fitted.

The gaskets 460 help the openings of the insulation duct 400 and the cold air duct 130 adhere closely to each other in closing the refrigerator door 110. Preferably, the gaskets 460 are formed of an elastic material to enhance performance of adherence.

Each of the gaskets 460 includes an elastic portion 460 and a fitting portion 464.

The elastic portion 462 is formed of an elastic material to adhere closely to an end portion of the opening of the cold air duct 130 provided to the body 100. The elastic portion 462 comes into contact with the end portion of the opening of the cold air duct 130 when the ice making room 140 comes into contact with one side of the body 100 by the rotation of the refrigerator door 110. In this case, the elastic portion 462 is compressed to adhere closely to an outer circumference of the end portion of the opening of the cold air duct 130, whereby a gap between the cold air duct 130 and the ice making room 140 disappears for airtightness.

The fitting portion 464 is provided along an outer circumference of the elastic portion 462. The fitting portion 464 is provided to attach the gasket 460 to the inner case 124. The gasket 460 is configured to have a disc shape. Preferably, the fitting portion 464 is formed of a plastic material having a prescribed rigidity.

A center of the fitting portion 464 is perforated to enable cold air to pass through. Fitting protrusions 465 corresponding to the gasket fitting holes 436 of the support bracket 430 are provided to the fitting portion 464, whereby the gasket 460 can be attached to the support bracket 430.

Hence, the attachment of the gaskets 460 enhances the airtightness performance between the insulation duct 400 and the cold air duct 130.

Meanwhile, in case that a user closes the refrigerator door 110, the gasket 460 comes into the inner case 124 corresponding to the position of the fitting portion 432 of the corresponding support bracket 430 fitted into the insulation duct 400. In this case, the support bracket 430 formed of an injection-molded plastic material having relatively high rigidity is able to support the weight applied by the gasket 460. So, despite the weight attributed to the repetitive contacts by the gasket 460, the support bracket 430 is able to support the insulation duct 400 to prevent from being transformed.

Accordingly, the present invention provides the following effects or advantages.

First of all, a tube guide is provided to be spaced with a prescribed gap apart from a backside of an outer case of a refrigerator. So, when an inside of a cold storage door is charged or filled with a foaming liquid, it can be evenly and smoothly charged with the foaming liquid. Hence, insulation efficiency of the refrigerator door can be raised and overall cooling performance of a refrigerator can be enhanced.

Secondly, an ice making unit is fixed by a fixing unit provided to an outer case of a refrigerator door. Compared to the related art of installing an ice making unit at an inner case in direct, the present invention is able to prevent transformation and breakage of an inner case.

Thirdly, a guide part is provided to an ice making unit. If a user closes a refrigerator door, water splashed on the ice making unit is reintroduced into the ice making unit. Hence, the present invention is able to prevent water from being splashed and frozen on other parts except the ice making unit.

Finally, a refrigerator employing a refrigerator door according to the present invention is a bottom freeze type refrigerator but is applicable to any kinds of refrigerators provided with a dispenser regardless of a refrigerator type. Furthermore, if a dispenser is provided to a freezer room, the present invention is applicable to a freezer room door.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator door, comprising:

an outer case defining an exterior side of the refrigerator door;

an inner case provided within the outer case and defining an interior side of the refrigerator door, wherein a space formed between the inner case and the outer case is configured to be filled with a foaming liquid;

an ice making unit coupled to the inner case, the ice making unit comprising:

a receptacle having an ice making space formed therein that receives water to be made into ice;

a driver installed in a driver case positioned at a side of the receptacle, the driver case having at least a top surface, a front surface and a side surface that is perpendicular to both the top and the front surface, said front surface parallel to the inner case; and a splash preventing device that prevents water in the receptacle from splashing out of the receptacle due to motion of the door, the splash preventing device comprising a guide recess formed in the side surface of the driver case that is adjacent to the receptacle, the guide recess having first and second side walls extending a depth of the recess and a splash guard surface extending between said walls, wherein said first side wall extends downward from the front surface of the driver case and said second side wall extends downward from the top surface of the driver case, and is spaced apart from the first side wall, and wherein a distance between the first and second side walls decreases gradually from a top end of the guide recess to a bottom end of the guide recess so as to have a downwardly tapering shape, wherein a loading boss of the driver case is received in the bottom end of the guide recess so as to guide water back into the receptacle;

a fixing unit provided in the space formed between the inner case and the outer case so as to fix the ice making unit to the refrigerator door; and a dispenser provided on the exterior side of the refrigerator door to discharge ice supplied by the ice making unit.

2. The refrigerator door as claimed in claim 1, the ice making unit further comprising:

an assembling part that extends outward from one side of the receptacle so as to be fixed to the fixing unit; and an ice transferring lever that rotates within the receptacle to transfer ice out of the receptacle, wherein the driver comprises a motor that drives the ice transferring lever.

3. The refrigerator door as claimed in claim 2, wherein the ice transferring lever is rotatably connected to the loading boss provided on the driver case, and wherein the downwardly tapering shape of the guide recess terminates at the loading boss.

4. The refrigerator door as claimed in claim 1, wherein the distance between the first and second side walls decreases gradually and continuously, without increasing, from the top end to the bottom end of the guide recess such that the distance between the first and second side walls is smallest at the bottom end of the guide recess.

5. An ice making unit provided within a refrigerator door, comprising:

a receptacle having an ice making space formed therein in which water to be made into ice is received;

a driver installed in a driver case positioned at a side of the, the driver case having at least a top surface, a front surface and a side surface that is perpendicular to both the top and the front surface, said front surface parallel to the inner case; and a splash guide that guides water having been directed thereto from the receptacle due to movement of the refrigerator door back into the receptacle, the splash guide comprising a recess of a prescribed depth formed in the side surface of the driver case that is adjacent to the receptacle, the recess comprising first and second side walls extending a depth of the recess and a splash guide surface extending between said first and second side walls, wherein said first side wall extends downward from the front surface of the driver case and said second side wall extends downward from the top surface of the driver case, and is spaced apart from the first side wall, and wherein a distance between the first and second side walls decreases gradually from a top end of the recess to a bottom end of the recess so as to have a downwardly tapering shape, wherein a loading boss of the driver case is received in the bottom end of the recess so as to guide water back into the receptacle.

6. The ice making unit provided with the refrigerator as claimed in claim 5, further comprising:

an ice transferring lever that rotates within the receptacle to transfer ice out of the receptacle, wherein the driver comprises a motor that drives the ice transferring lever.

7. The ice making unit provided with the refrigerator as claimed in claim 6, wherein the ice transferring lever is rotatably connected to a loading boss provided on the driver case, and wherein the downwardly tapering shape of the splash guide terminates at the loading boss.

8. The ice making unit provided with the refrigerator as claimed in claim 5, wherein the distance between the first and second side walls decreases gradually and continuously, without increasing, from the top end to the bottom end of the recess such that the distance between the first and second side walls is smallest at the bottom end of the guide recess.

9. An ice maker installed on a refrigerator door, comprising:

a receptacle coupled to the refrigerator door, the receptacle having an ice making space formed therein in which water to be made into ice is received;

an ice transferring lever that extends across the receptacle in a longitudinal direction thereof and is rotatably installed in the receptacle so as to transfer ice out of the receptacle;

a driver installed in a driver case positioned at a lateral side of the receptacle, wherein the driver selectively rotates the ice transferring lever; and a splash guide formed as a recess in a side wall of the driver case that is adjacent to the receptacle, wherein a surface of the side wall of the driver case in which the recess is formed is perpendicular to the extending direction of the ice transferring lever, said recess having first and second side walls extending a depth of the recess and a splash guide surface extending between said first and second side walls, and wherein a distance between said first and second side walls is greater at a top end of the recess than at a bottom end of the recess so as to have a downwardly tapering external shape, wherein a loading boss of the driver case is received in the bottom end of the recess so as to guide water having been directed thereto from the receptacle due to movement of the refrigerator door back into the receptacle.

10. The ice maker installed on a refrigerator door of claim 9, further comprising a loading boss provided at a coupling point between the ice transferring lever and the driver case, wherein the bottom end of the recess that defines the splash guide is positioned at the loading boss.

11. The ice maker installed on a refrigerator door of claim 9, wherein the distance between the two opposite lateral side walls of the recess gradually and continuously increases from the top end to the bottom end thereof, without increasing.

* * * * *